US005740856A

United States Patent [19]

Ritter

[11] Patent Number: 5,740,856

[45] Date of Patent: Apr. 21, 1998

[54] ROTARY REGENERATIVE HEAT EXCHANGER WITH MULTIPLE LAYER BASKETS

[75] Inventor: Kent E. Ritter, Wellsville, N.Y.

[73] Assignee: ABB Air Preheater Inc., Wellsville, N.Y.

[21] Appl. No.: 848,589

[22] Filed: Apr. 28, 1997

[51] Int. Cl.[6] ..... F28D 19/00

[52] U.S. Cl. ..... 165/10; 165/6; 165/8

[58] Field of Search ..... 165/10, 8, 6, 4

[56] References Cited

U.S. PATENT DOCUMENTS

| | | | |
|---|---|---|---|
| 2,432,198 | 12/1947 | Karlsson et al. | 165/10 |
| 4,182,402 | 1/1980 | Adrian | 165/10 |
| 4,209,060 | 6/1980 | Wiking et al. | 165/8 |
| 4,561,492 | 12/1985 | Bellows | 165/8 |
| 5,454,418 | 10/1995 | Brophy et al. | 165/8 |
| 5,615,732 | 4/1997 | Brophy et al. | 165/8 |
| 5,664,620 | 9/1997 | Ritter | 165/8 |

*Primary Examiner*—John Rivell
*Assistant Examiner*—Christopher Atkinson
*Attorney, Agent, or Firm*—Alix, Yale & Ristas, LLP

[57] ABSTRACT

The modular heat exchange baskets for a rotary regenerative air preheater which normally have a single stacked array of heat exchange plates, are constructed with heat exchange plate support bars intermediate the top and bottom surface. The basket then has two separate stacked arrays of heat exchange plates which permits the plate material or arrangement in the top of each basket to be different from the plate material or arrangement in the bottom. For side loaded air preheaters with basket support gratings, the arrangement of heat exchange plates can be changed without the need to move the gratings.

2 Claims, 4 Drawing Sheets

ROTARY REGENERATIVE HEAT EXCHANGER WITH MULTIPLE LAYER BASKETS

BACKGROUND OF THE INVENTION

The present invention relates generally to rotary regenerative heat exchangers and, more particularly, to improved modular heat exchange baskets which permit flexibility in arranging various types or configurations of heat absorbent material.

A rotary heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a vertical central rotor post and divided into a plurality of sector-shaped compartments by a plurality of radial partitions or diaphragms extending from the rotor post to the outer peripheral shell of the rotor. These sector-shaped compartments are loaded with modular heat exchange baskets which contain the mass of heat absorbent material commonly comprised of stacked plate-like elements.

The rotor is surrounded by a housing and the ends of the rotor are partially covered by sector plates which divide the housing into gas and air sides. In order to improve the efficiency of operation, it is conventional to provide seals, which are referred to as radial seals, on the ends of the rotor such that the seals will come into proximity with the sector plates and minimize the flow or leakage between the air and gas sides at the ends of the rotor. These seals are normally attached to the edges of the diaphragms.

The modular heat exchanger baskets may be of the open frame type or they may have solid side walls. Also, the baskets may be loaded axially into the sector-shaped compartments of the rotor from the top end or they may be loaded radially through the periphery of the rotor. In the former case, the modules sit on top of each other. In the latter case, the baskets are supported on gratings fixed between the diaphragms at each end of the rotor and between layers of baskets.

In rotary regenerative heat exchangers, it is often desirable to employ different forms of heat absorbent material or plate at various levels. For example, the material at the hot end of the rotor where the hot gases enter and the heated air exits may need to be quite different from the material at the cold end, or for that matter, at the center. Therefore, it is advantageous to be able to vary these heat exchange materials in the baskets with varying conditions. With conventional types of rotors and baskets, this can only be done by completely changing the mass of heat exchange material for a particular level of baskets or by modifying the rotor structure (grate location) and the basket design (axial height).

SUMMARY OF THE INVENTION

The present invention relates to a rotary regenerative heat exchanger and to a novel modular heat exchange basket for use in the heat exchanger. At least some of the heat exchange baskets are constructed such that multiple levels of different heat absorbent material can be placed in each basket. Specifically, support means are located in such baskets at a selected level between the top and bottom of the basket such that heat exchange material of one type can be located above that support means and heat exchange material of another type can be located below that support means. The support means in the module can be changed to vary the proportions without needing to change the support gratings of the rotor structure.

DESCRIPTION OF THE PREFERRED EMBODIMENT

Figure 1:
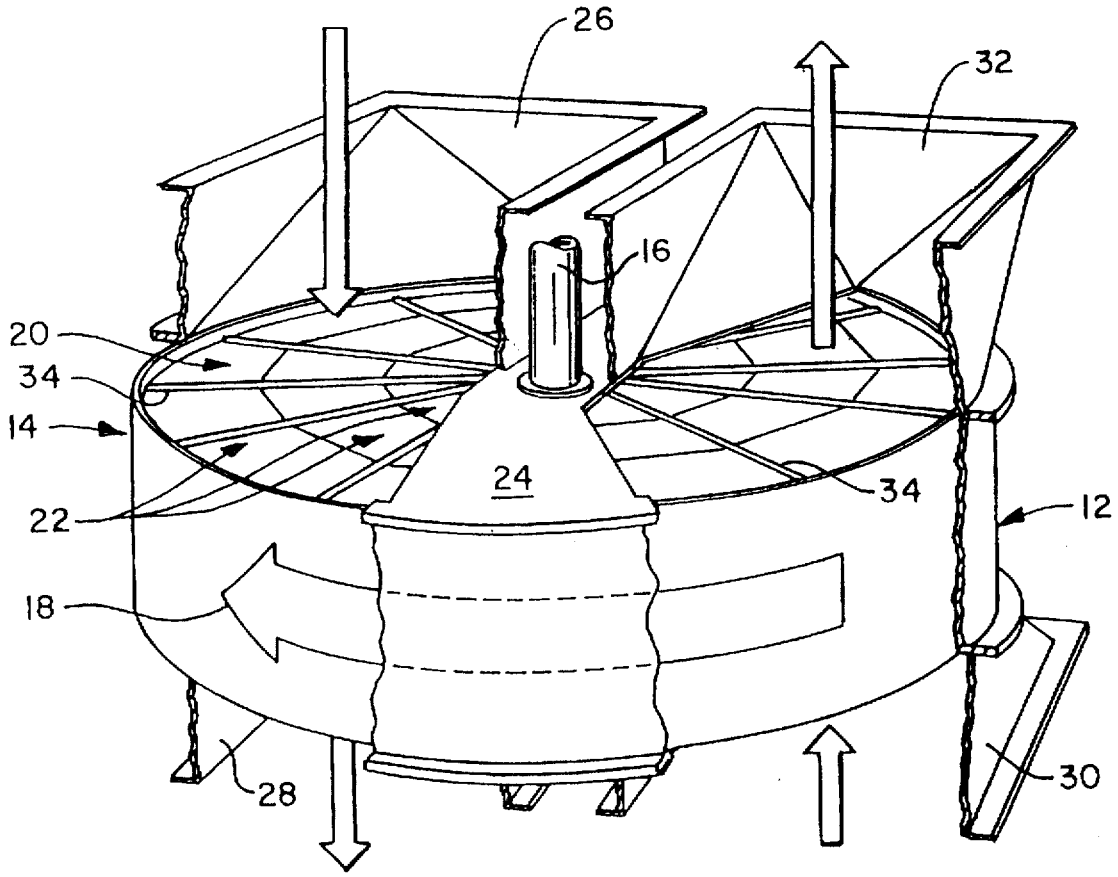
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32.

Although the present invention can be applied to air preheaters which are axially loaded from the top, the invention is particularly applicable to air preheaters which contain basket support gratings and which are radially loaded through the periphery of the rotor. Therefore, the invention will be described with reference to radial loading.

Figure 2:
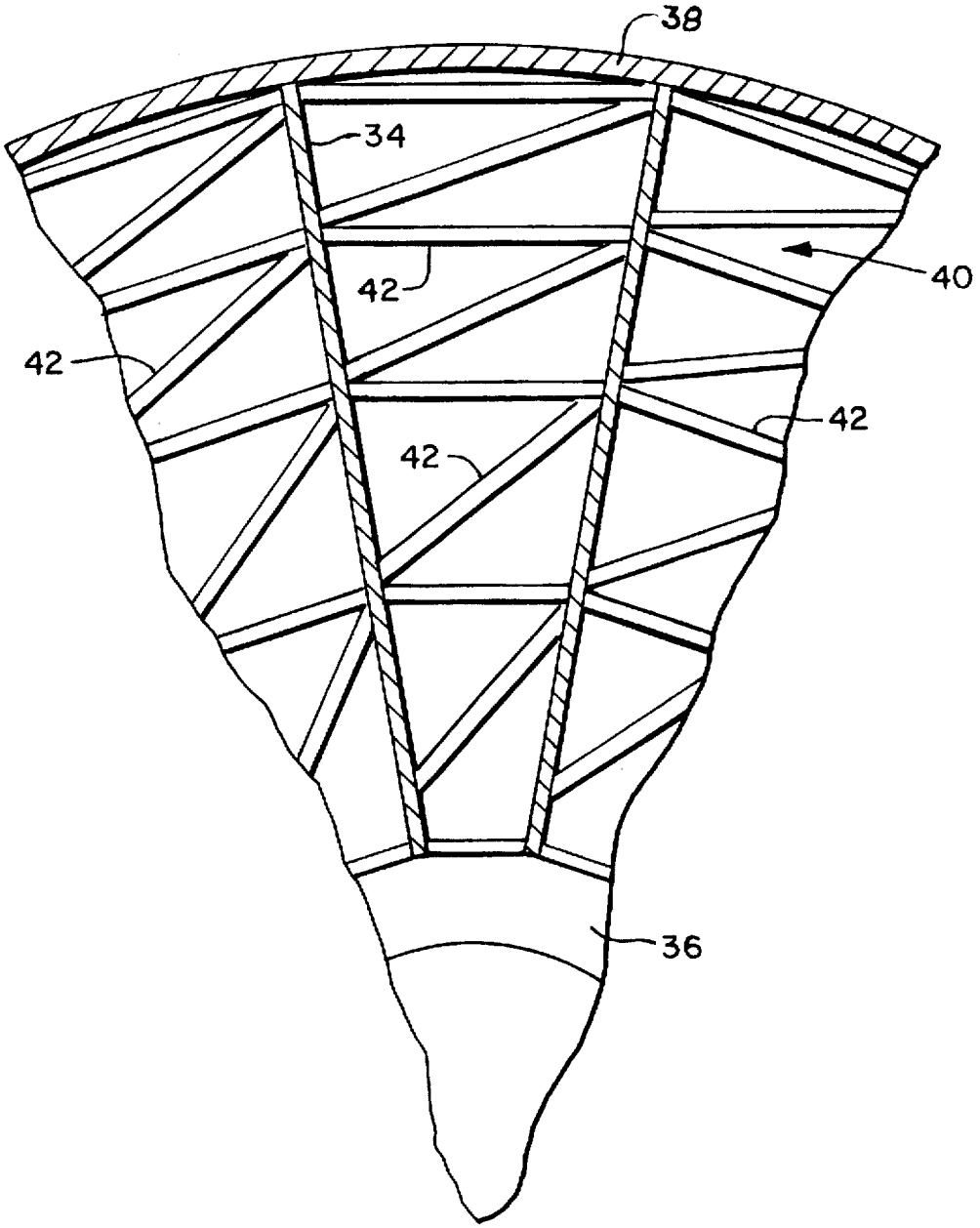
FIG. 2 is a top cross section view of a portion of the rotor of the preheater of FIG. 1 illustrating the support gratings in position between diaphragms.

Referring now to FIG. 2 which shows a plan view in cross section of a portion of a rotor, the diaphragms 34 are shown in cross section extending radially between the central portion 36 of the rotor and the rotor shell 38. This FIG. 2 is a view before the basket modules have been installed. Supported between and attached to the diaphragms 34 are the support gratings 40. These support gratings are formed from the members 42 and are normally truss-like structures. Any desired truss configuration can be used as long as it is structurally designed to support the baskets. The gratings are suitably attached to the diaphragms 34 such as by welding. As is conventional, there are a plurality of levels of gratings in each sector.

Figure 3:
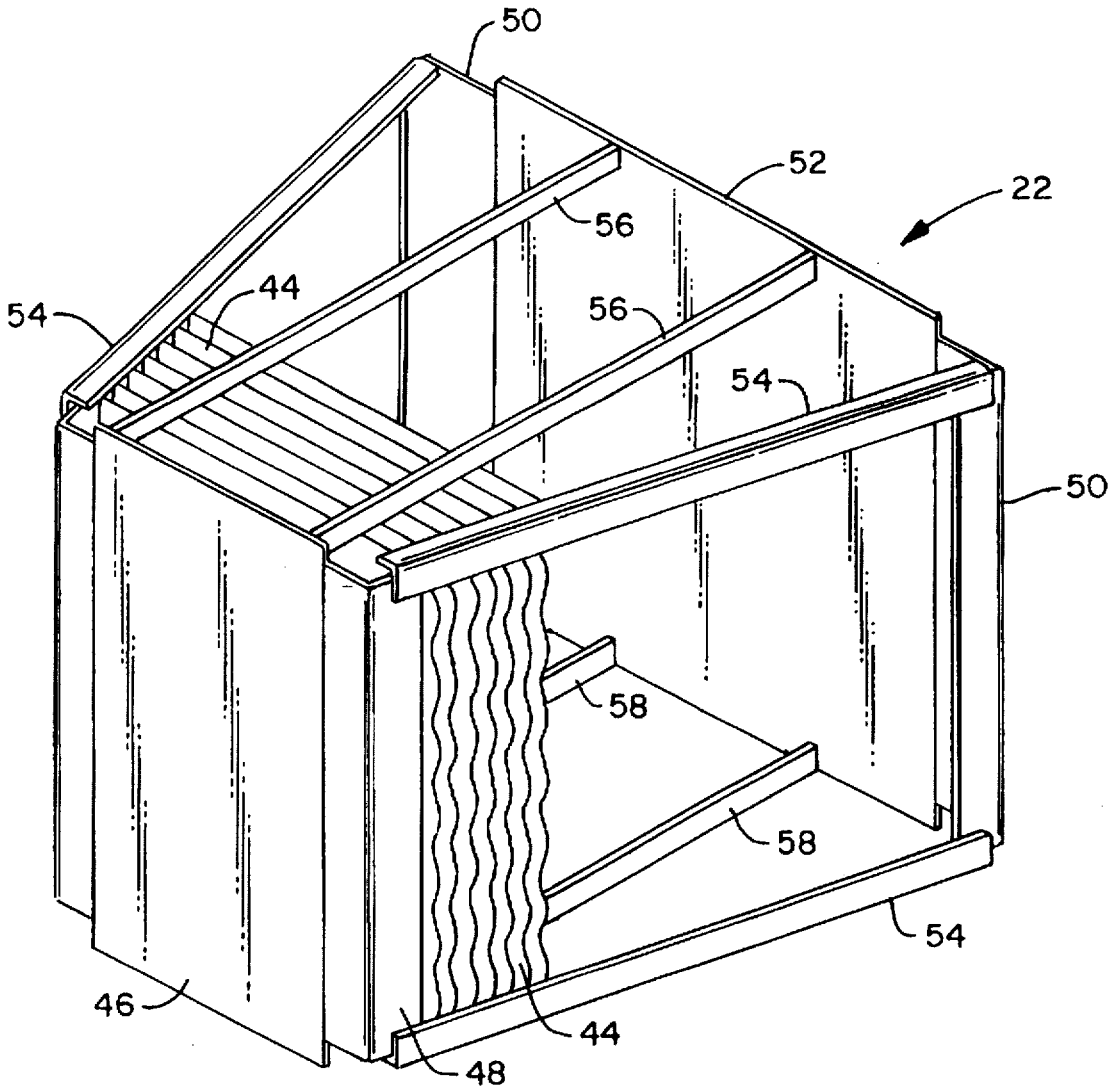
FIG. 3 PRIOR ART
FIG. 3 is a perspective view of a typical prior art modular heat exchange basket.

FIG. 3 illustrates a single, prior art heat transfer element basket 22 showing a portion of the heat transfer plates 44. Of course, the basket would be filled with these heat transfer plates but the remainder have been omitted for clarity. The frame of the basket 22 comprises a nose piece or inner end 46 which is bent outwardly at the sides to form the corners 48. The outer end of the basket is defined by the outboard corner angles 50 which are attached by welding to the outer end piece 52. The inner and outer ends are connected by the welded side angles 54 and the upper and lower tie bars 56 and 58 respectively. All of these members together form the basic framework of the basket. Although the sides of the basket have been illustrated as being open, they could also be closed by metal side plates. As seen in this FIG. 3, the heat transfer plates 44 extend from the top to the bottom of the basket and are supported on the lower tie bars 58.

Figure 4:
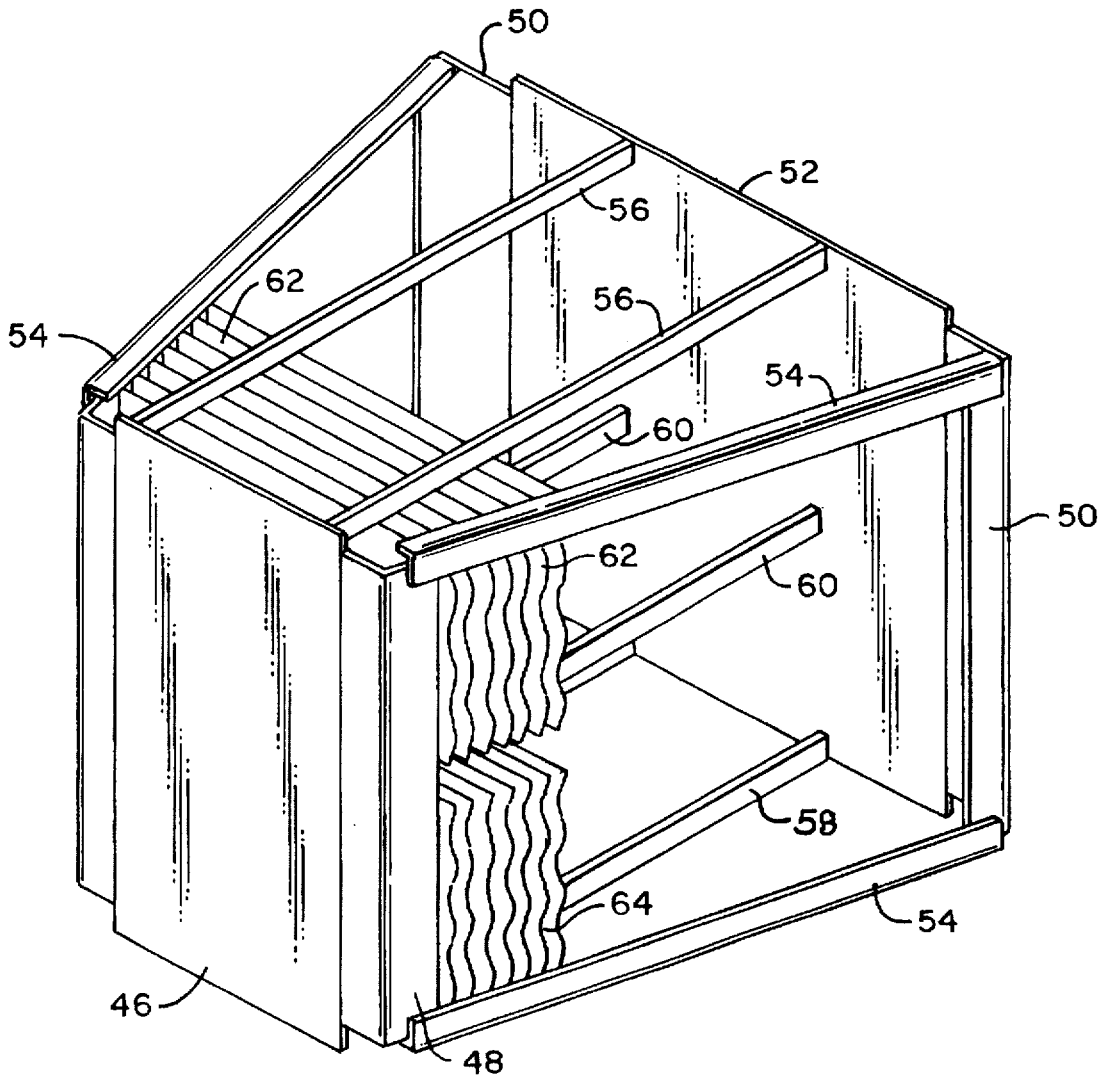
FIG. 4 is a perspective view of a basket similar to FIG. 3 and illustrating the present invention.

FIG. 43 illustrates the present invention as it would be applied to the prior art basket of FIG. 3. In FIG. 4, additional tie bars 60 are provided which are located between the upper and lower tie bars 56 and 58. Although these tie bars 60 are illustrated as being approximately mid way between the top and bottom, they can be located at any desired level.

As illustrated in FIG. 4, the heat transfer plates in the basket 22 of the present invention are now divided into a group of upper plates 62 and a group of lower plates 64. The upper and lower groups of plates can now be formed of different material or formed in different configurations as desired for a particular application. For example, the plates 62 in the top of the basket may be of one material, spacing or configuration, while the plates 64 in the bottom of the basket may be of a different material, spacing or configuration. As shown in FIG. 4, the plates 64 are spaced wider apart than the plates 62.

The present invention permits the heat exchange plates within each basket section to be changed as desired to change the mix of different types of plates in the overall air preheater. This can eliminate the necessity to make changes in the basic rotor construction, such as changing the location of gratings, in order to adjust that mix. The support bars in each basket can now be located or moved to give the optimum performance without altering the rotor structure.

I claim:

1. A heat transfer element basket assembly for a rotary regenerative heat exchanger comprising:

a. a basket framework including first and second end plates disposed at inner and outer ends of said basket and means attaching said first and second end plates in spaced relationship, said basket framework having top and bottom surfaces;

b. a first set of heat exchange plate support bars extending between said first and second end plates adjacent said bottom surface;

c. a second set of heat exchange plate support bars extending between said first and second end plates at a position intermediate said top and bottom surfaces;

d. a first set of heat exchange plates juxtaposed in a stacked array between said first and second end plates and supported on said first set of heat exchange plate support bars; and e. a second set of heat exchange plates juxtaposed in a stacked array between said first and second end plates and supported on said second set of heat exchange plate support bars.

2. A heat transfer element basket assembly as recited in claim 1 wherein said first set of heat exchange plates are different from said second set of heat exchange plates.

* * * * *